United States Patent [19]

Reynolds

[11] 3,967,403

[45] July 6, 1976

[54] MANUALLY-OPERATED FIREARM WITH FORWARD-MOVING BARREL AND AUTOMATIC BREECH LOCK

[75] Inventor: George L. Reynolds, Cambridge, Ill.

[73] Assignee: The United States of America as represented by the Secretary of the Army, Washington, D.C.

[22] Filed: Jan. 22, 1975

[21] Appl. No.: 543,101

[52] U.S. Cl. ..... 42/10; 42/1 F

[51] Int. Cl.[2] ..... F41C 27/06

[58] Field of Search ..... 42/10, 1 F

[56] References Cited

UNITED STATES PATENTS

| | | | |
|---|---|---|---|
| 3,332,162 | 7/1967 | Martwick et al. | 42/1 F |
| 3,404,479 | 10/1968 | Silsby | 42/1 F |
| 3,408,761 | 11/1968 | Silsby | 42/1 F |
| 3,416,252 | 12/1968 | Silsby | 42/1 F |
| 3,538,635 | 11/1970 | Friend | 42/10 |
| 3,641,691 | 2/1972 | Ellis et al. | 42/1 F |

*Primary Examiner*—Charles T. Jordan

*Attorney, Agent, or Firm*—Nathan Edelberg; A. Victor Erkkila; Thomas R. Webb

[57] ABSTRACT

The disclosed firearm comprises a stationary receiver or frame, a breech block slidably mounted in the receiver and engaging a forward-facing abutment on the receiver in firing position, a barrel slidably mounted on the receiver for rectilinear and transverse motion at its rear end, interlocking abutments on the barrel and receiver engaged by the transverse motion for locking the barrel to the breech block in firing position. Forward movement of the barrel to open the breech during firing is prevented by the locking abutments and the firing reaction on the breech block. The barrel and breech block can be moved forward after firing to disengage the interlocking abutments and open the breech. A manually-operated extractor-ejector member is disclosed.

8 Claims, 5 Drawing Figures

MANUALLY-OPERATED FIREARM WITH FORWARD-MOVING BARREL AND AUTOMATIC BREECH LOCK

GOVERNMENT INTEREST

The invention described herein may be manufactured, used and licensed by or for the Government for governmental purposes without the payment to me of any royalty thereon.

BACKGROUND AND SUMMARY OF THE INVENTION

This invention relates to manually-operated breech-loading firearms, and particularly to such firearms having a barrel that is moved forward after firing to open the breech at the rear of the barrel bore. Firearms of this type normally are provided with means for mechanically locking the barrel and breech block against any motion in closed position during firing, and such means must be released after firing to open the breech.

An object of the present invention is to eliminate the usual mechanical locking means, and provide a firearm with connecting means between the breech block, the barrel and the receiver that effectively lock the breech block, barrel and receiver together during firing and automatically release the barrel after firing to permit forward movement thereof to open the breech.

In accordance with the invention, the firearm comprises a stationary receiver or frame, a breech block movable in the receiver, a barrel slidably mounted for forward and rearward movement on the receiver and connected at its rear or breech end to the breech block in firing position, whereby forward movement of the barrel to open the breech during firing is prevented by the breech block connection and the firing reaction on the breech block, but the barrel is automatically released after firing so that it can be moved forward to open the breech. The barrel is automatically disconnected from the breech block during the first part of the forward motion thereof, after which the breech block is stopped and the barrel can be moved forward relative to the breech block to open the breech for reloading. A detent may be provided for holding the breech block in its forward position during reloading.

Reference is made to an application of George E. Cooksey, entitled "Manually-Operated Firearm With Forward Sliding Barrel and Pivoted Breech Block", Ser. No. 543,100, filed Jan. 22, 1975, with the same assignee, on which some of the claims herein are readable.

DETAILED DESCRIPTION OF A PREFERRED EMBODIMENT

Figure 2:
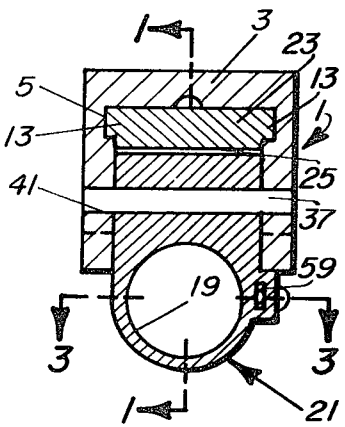
FIG. 2 is a transverse section view, taken on line 2—2 of FIG. 1, with the cartridge removed.
Figure 3:
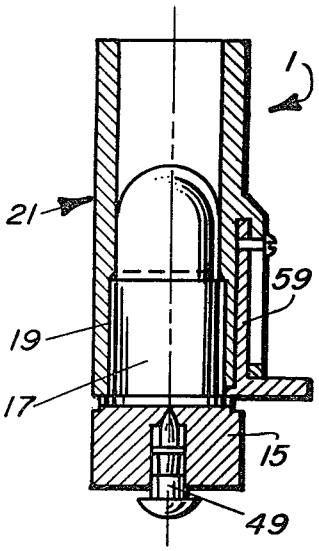
FIG. 3 is a transverse section view taken on line 3—3 of FIG. 2.
Figure 1:
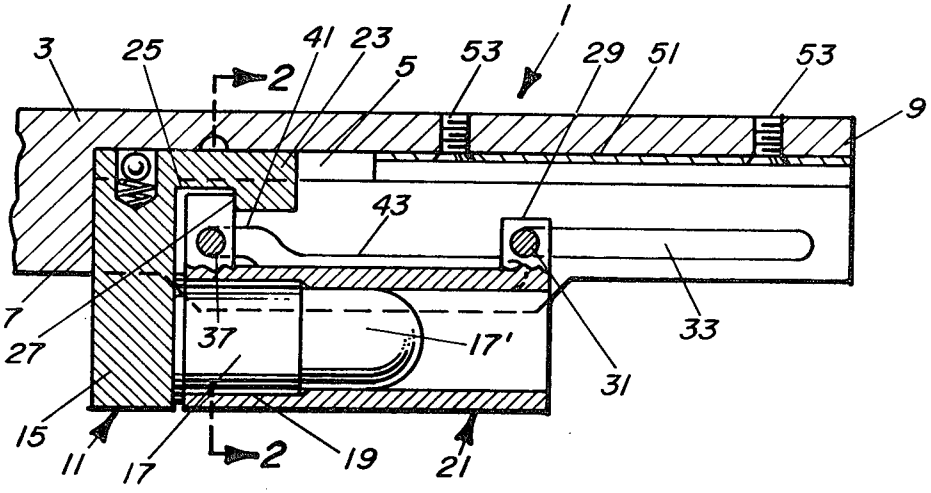
FIG. 1 is a vertical longitudinal section view of a portion of a firearm embodying the present invention, taken on line 1—1 of FIG. 2, with the parts in firing position.

FIGS. 1-3 show a forwardly-moving breech-loading barrel firearm 1 embodying the present invention. The firearm 1 comprises a receiver or frame 3 having an elongated, rectilinear, T-shaped cavity 5 extending from a rear abutment 7 forwardly to the extreme front end 9 thereof. A breech block 11, having side ribs 13 to form a T-shaped cross-section, is slidably mounted in cavity 5 for limited forward and rearward movement in receiver 3. The breech block 11 comprises a first section 15, which extends downward beyond the receiver 3 to back up a cartridge 17 in the breech end 19 of a barrel 21, and a forward-extending, barrel-locking second section 23 having a notch 25 forming a rearward-facing locking abutment 27. The barrel 21 is mounted for forward and rearward movement in the receiver by an apertured front lug 29 and a first transverse pin 31 which extends through lug 29 and a pair of straight, longitudinal first slots 33 in the receiver 3, and a rear lug 35 and a second transverse pin 37 which extends through lug 35 and a pair of second slots 39 in the receiver 3. Each slot 39 is made up of a short, straight, longitudinal section 41 and a long, straight, longitudinal section 43, connected by an inclined section 45. The rear lug 35 is longer than front lug 29 to provide a forward-facing locking abutment 47 at the upper end thereof. When the breech block 11 and barrel 21 are in their rearmost positions, as shown in FIG. 1, the pin 37 is in the short slot section 41 and the abutments 27 and 47 are interlocked, thus locking the breech block 11 and barrel 21 together, and the pin 31 is at the rear end of its slots 33.

Figure 4:
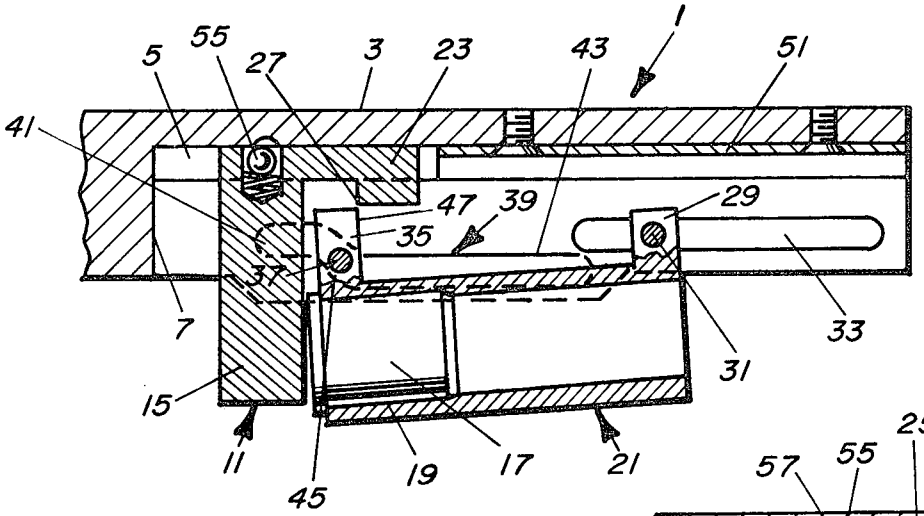
FIGS. 4 and 5 are views similar to FIG. 1, with the parts in two other positions.
Figure 5:
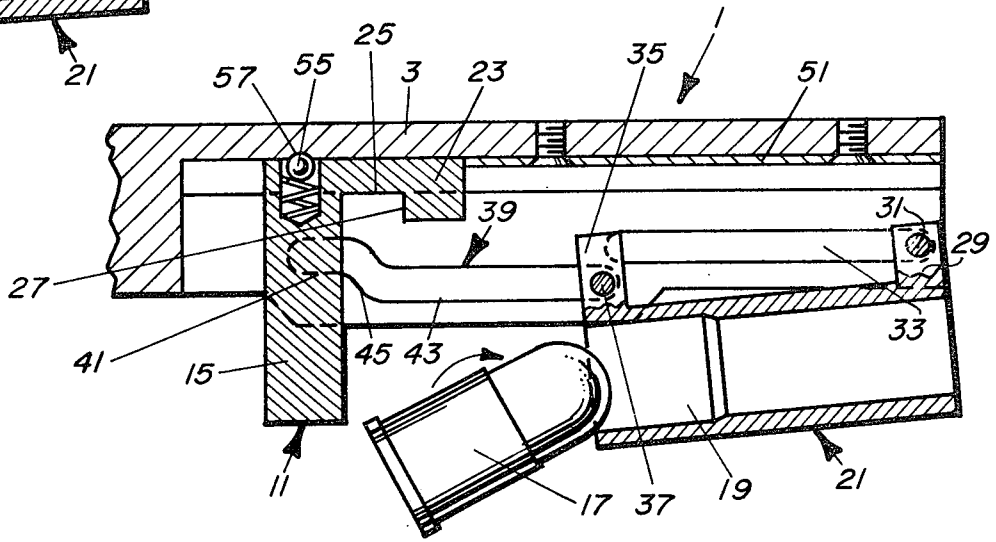

When the firearm 1 is fired, as by a hammer (not shown), striking a firing pin 49 (FIG. 3), the cartridge 17 is fired, ejecting the projectile or bullet 17′ from the barrel. The rearward reaction exerted on the cartridge case and breech block 11 by the burning propellant prevents the locked barrel and breech block unit from being moved forward at or during firing. However, after firing, as soon as the firing reaction has subsided, the locked barrel and breech block unit can be moved forward manually to open the breech. As the barrel 21 is moved forward, the pin 37 rides in longitudinal slots 41 and keeps the abutments 27 and 47 interlocked. As pin 37 rides down the inclined slots 45, it moves the rear lug 35 downward as shown in FIG. 4, releasing abutment 47 from abutment 27. Just beyond the position shown in FIG. 5, the breech block 11 is stopped by the rear end of a stop strip 51 which is mounted, as by screws 53, in the cavity 5, as shown in FIG. 5. A spring-pressed detent ball 55 may be mounted in the breech block 11 to seat in a detent recess 57 in the receiver 3, for holding the breech block in this forward position during reloading. The barrel 21 is moved further to the position shown in FIG. 5, opening the breech to permit removal of the fired case and insertion of a new cartridge. The fired case may be extracted by a manual extractor 59, shown in FIGS. 2 and 3. After insertion of a new cartridge into the breech end 19, the barrel 21 is manually moved rearward to close the breech. When the barrel 21 engages the breech block section 15, it moves the breech block rearward, releasing detent 55, and the inclined slots 45 and pin 37 raise the barrel abutment 47 behind the breech block abutment 27, thus locking the barrel and breech block together.

The foregoing disclosure and drawings are merely illustrative of the principles of this invention and are not to be interpreted in a limiting sense. I wish it to be understood that I do not desire to be limited to the exact details of construction shown and described, because obvious modifications will occur to a person skilled in the art.

What is claimed is:

1. A breech-loading firearm comprising:

a stationary receiver having a forward-facing first abutment;

a breech block mounted for forward and rearward movement in said receiver and having a rearward-facing second abutment engaging said first abutment in firing position;

a barrel mounted for forward and rearward movement on said receiver; and means for locking the breech end of said barrel to said breech block in firing position;

whereby forward movement of said barrel to open the breech at the rear of the barrel bore during firing is prevented by said locking means and the rearward reaction of of the expanding gases on said breech block, but said barrel and breech block can be moved forward after firing to open the breech.

2. A firearm as in claim 1, wherein said locking means includes means for moving said breech end of said barrel downward as the barrel moves forward to open the breech.

3. A firearm as in claim 1, wherein: said locking means is automatically unlocked during a short forward movement of said barrel and breech block after firing; and then said breech block engages a stop on said receiver and said barrel continues forward to open the breech for re-loading.

4. A firearm as in claim 3, further comprising a breech block detent movably mounted in said breech block, with a spring biasing said detent into engagement with a detent notch in said receiver when said breech block engages said stop, to prevent premature rearward movement of said breech block.

5. A firearm as in claim 3, wherein said locking means includes forward- and rearward-facing third and fourth abutments on said barrel and said breech block, respectively, and pin-and-angled slot means on said barrel and receiver, for moving the barrel abutment downwardly, out of engagement with the breech block abutment as said barrel is moved forward.

6. A firearm as in claim 5, wherein said pin-and-angled slot means comprises at least one transverse pin on said barrel extending through a receiver slot having two straight sections connected by an inclined section.

7. A firearm as in claim 6, further comprising at least one additional transverse pin on the forward end of said barrel extending through a straight slot in said receiver, for guiding said forward end.

8. A firearm as in claim 7, further comprising a T-shaped head on said breech block sliding in a corresponding T-shaped channel in said receiver, for guiding said breech block.

* * * * *